US005140228A

United States Patent [19]

Biegel

[11] Patent Number: 5,140,228

[45] Date of Patent: Aug. 18, 1992

[54] APPARATUS FOR REGULATING THE INTENSITY OF LIGHT EMITTED BY A LAMP

[75] Inventor: George E. Biegel, Framingham, Mass.

[73] Assignee: Stocker & Yale, Inc., Beverly, Mass.

[21] Appl. No.: 484,112

[22] Filed: Feb. 23, 1990

[51] Int. Cl.[5] ..... H05B 41/36

[52] U.S. Cl. ..... 315/291; 315/306; 315/284; 315/310; 315/DIG. 4; 315/241 R

[58] Field of Search ..... 315/291, 284, DIG. 4, 315/289, 240, 105, 210, 308, 224, 310, 291 R; 323/208, 232, 233

[56] References Cited

U.S. PATENT DOCUMENTS

| | | | |
|---|---|---|---|
| 380,945 | 4/1888 | Shallenberger | 315/285 |
| 3,551,799 | 12/1970 | Koppelmann | 323/210 |
| 3,919,592 | 11/1975 | Gray | 315/199 |
| 3,936,696 | 2/1976 | Gray | 315/224 |
| 4,127,795 | 11/1978 | Knoll | 315/DIG. 4 |
| 4,162,428 | 7/1979 | Elms | 315/284 |
| 4,162,429 | 7/1979 | Elms et al. | 315/284 |
| 4,350,934 | 9/1982 | Spreadbury | 315/282 |
| 4,441,054 | 4/1984 | Bay | 315/DIG. 4 |
| 4,443,740 | 4/1984 | Goralnik | 315/284 |
| 4,559,479 | 12/1985 | Munson | 315/DIG. 4 |
| 4,562,384 | 12/1985 | Owen | 315/276 |

FOREIGN PATENT DOCUMENTS

| | | | |
|---|---|---|---|
| 1224837 | 9/1966 | Fed. Rep. of Germany | 315/DIG. 4 |

*Primary Examiner*—Eugene R. LaRoche
*Assistant Examiner*—Son Dinh
*Attorney, Agent, or Firm*—Fish & Richardson

[57] ABSTRACT

A control circuit is disclosed that can be used to control the light intensity of a fluorescent lamp. A first embodiment of the control circuit includes one variable inductor and a plurality of fixed inductors. A switch is used to connect one of the inductors to the fluorescent lamp in parallel. The intensity of the light output from the lamp is varied either by adjusting the inductance of the variable inductor, or by switching between the fixed inductors. A second embodiment uses a variable capacitor in place of the variable inductor and uses fixed capacitors in place of the fixed inductors.

62 Claims, 4 Drawing Sheets

APPARATUS FOR REGULATING THE INTENSITY OF LIGHT EMITTED BY A LAMP

FIELD OF THE INVENTION

This invention relates generally to lamps and specifically to a device used to regulate the intensity of or dim a lamp, especially a fluorescent lamp.

BACKGROUND OF THE INVENTION

Historically, there has been a need to accurately and efficiently reduce lamp light output or light intensity. When observing an object, the quantity of light is crucial to perceive the desired detail and/or effect. This requirement becomes more acute when a lens system is used in conjunction with the human eye, or other light detector. Cameras, video cameras, CCD detectors, and photo detectors all use lens systems to capture light. The performance of these detectors is affected by any flickering or variation in the intensity of the light. Fluorescent lamps are popular light sources, and use inverter power supplies that drive the lamps at 90V and 20khz to produce a steady, predictable illumination. It is desirable to be able to adjust and/or to instantly switch the intensity of the fluorescent lamp between different levels while keeping the illumination steady and predictable.

SUMMARY OF THE INVENTION

The invention generally features a lighting fixture, especially one that uses a fluorescent lamp, that has a control circuit that regulates the intensity of the light emitted by the lamp, to enable the light intensity to be set at any desired level while maintaining the consistency and quality of the light.

One embodiment of the invention generally features a lighting fixture comprising a lamp, a power source connected to the lamp to enable the lamp to emit light, and a control circuit including a variable inductor connected to the lamp for varying the light emitted by the lamp.

The invention also generally features a lighting fixture comprising a lamp, a power source connected to the lamp to enable the lamp to emit light, and a control circuit comprising an inductor connected to the lamp in parallel for varying the light emitted by the lamp.

The invention also generally features an apparatus comprising a load, a power source connected to the load to enable the load to perform a predetermined function, and a control circuit comprising a variable inductor connected in parallel to the load, wherein the power supplied to the load can be regulated by varying the inductance of the variable inductor.

In the preferred embodiment, the lamp is a discharge lamp such as a fluorescent lamp. The control circuit includes both a variable inductor and one or more fixed inductors having different fixed inductances. A switch allows an operator to select either a particular fixed inductor, or the variable inductor. The inductors are selectively connected to the lamp in parallel. The variable inductor can be varied either in step increments, or in continuous increments. In each of the above described embodiments, a variable capacitor can be substituted for the variable inductor, and fixed capacitors can be substituted for fixed inductors.

DETAILED DESCRIPTION OF THE PREFERRED EMBODIMENTS

Figure 1:
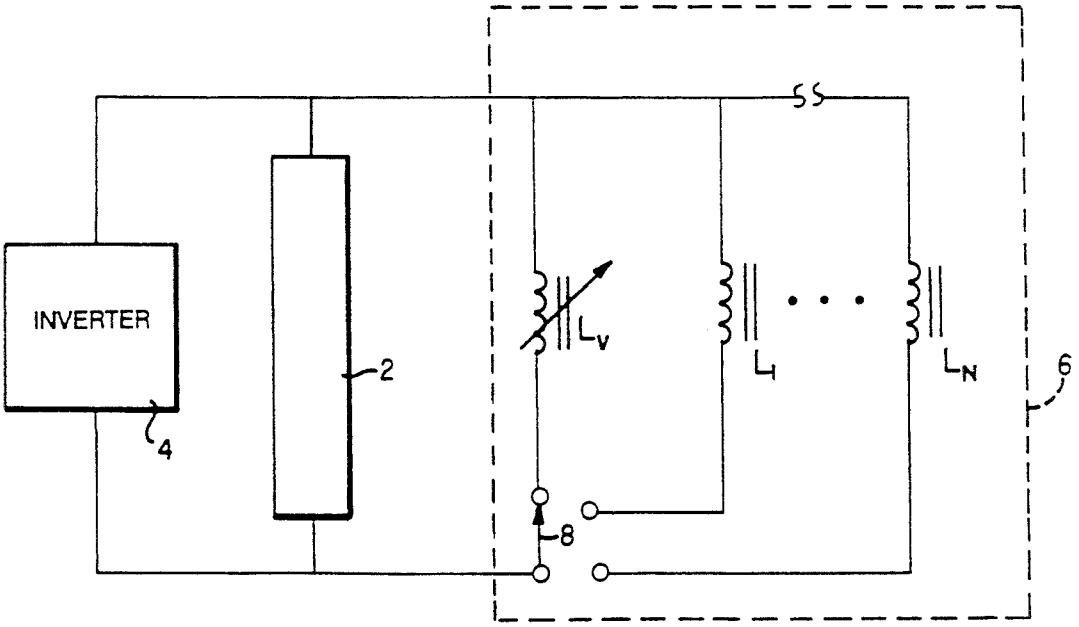
FIG. 1 is a schematic diagram of a preferred embodiment of the invention.

Referring to FIG. 1, power is supplied to a fluorescent lamp 2 from an appropriate power source (not shown) through a standard inverter 4 connected in parallel to lamp 2. The intensity of the light emitted from lamp 2 is regulated by a control circuit 6 that includes a variable inductor $L_V$ and a plurality of standard fixed inductors $L_1$–$L_N$. A switch 8 is adjustable to connect one of the inductors to lamp 2 in parallel. A complete lighting fixture includes other standard components (filters, etc.) well known to those skilled in the art and therefore not shown in FIG. 1.

Figure 2:
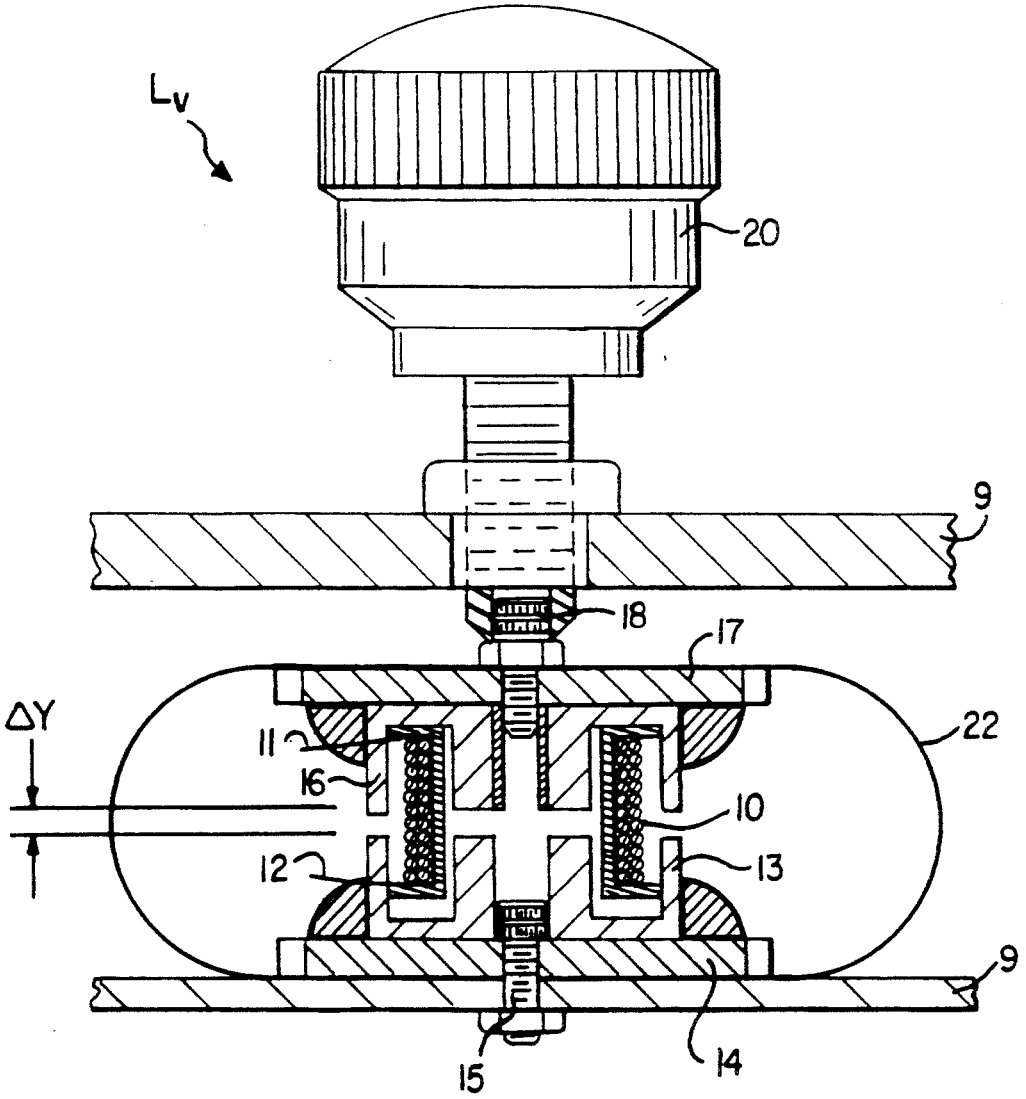
FIG. 2 is a detailed drawing of a variable inductor illustrated in FIG. 1.

Referring to FIG. 2, variable inductor $L_V$ is shown in more detail. Inductor $L_V$ is supported in a housing 9 and includes a coil 10 having leads 11, 12. Immediately beneath coil 10 is a ferrite core 13, which is secured to the lower part of housing 9 through a base 14 and a screw 15. The upper portion of coil 10 is attached to a second, movable ferrite core 16 which is positioned above ferrite core 13 with a gap $\Delta Y$ therebetween. Movable ferrite core 16 is attached at its upper end to a movable base 17. A screw 18 is secured to movable base 17, with the head of the screw positioned within a recess 19 in the bottom of a thumbscrew 20. Thumbscrew 20 is manually rotatable through a bore in housing 9. A spring 22 surrounds bases 14 and 17 and exerts a force that pulls bases 14 and 17 away from each other. Therefore, when thumbscrew 20 is rotated to move it away from housing 9, the head of screw 18 remains within recess 19 due to the force of spring 26. Ferrite core 16 will therefore also be raised which will increase $\Delta Y$, and decrease the inductance measured across leads 11, 12. Conversely, rotating thumbscrew 20 in the opposite direction will reduce $\Delta Y$ and result in an increase in inductance.

In operation, a user selects either variable inductor $L_V$ or one of fixed inductors $L_1$–$L_N$ using switch 8. If inductor $L_V$ is chosen, the intensity of the light emitted by lamp 2 can be varied by varying the inductance of inductor $L_V$ through rotation of thumbscrew 20. Fixed inductors $L_1$–$L_N$ have different inductances, each of which corresponds to a different desired intensity of the light emitted by lamp 2. For example, $L_1$ can be chosen so that the light emitted by lamp 2 will be reduced by 20% when switch 8 is adjusted to connect $L_1$ to lamp 2. Similarly, $L_2$ can be chosen to reduce the light emitted by lamp 2 by 40%, etc. Accordingly, a user can either choose $L_V$ and manually adjust the light intensity to a desired level, or can choose a fixed inductor which sets the light intensity at a predetermined level. Switch 8 can also be left in an open position which will effectively remove all of the inductors from the circuit causing lamp 2 to emit light at its normal or maximum intensity.

Figure 3:
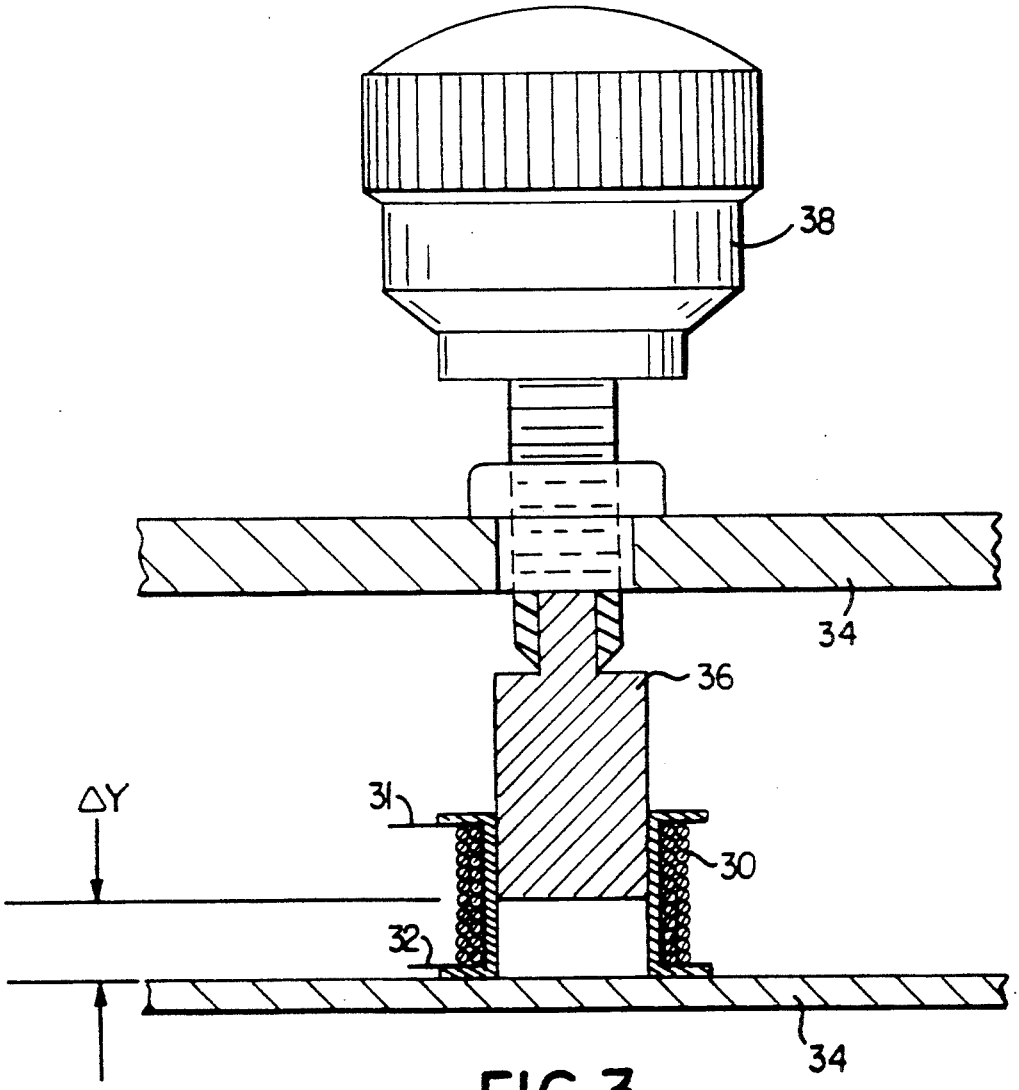
FIG. 3 is a detailed drawing of an alternate embodiment of the variable inductor illustrated in FIGS. 1 and 2.

FIG. 3 shows an alternate embodiment of variable inductor $L_V$. In this embodiment, a coil 30, having leads 31, 32, is attached to housing 34. A ferrite core 36, attached to a thumbscrew 38, can be raised and lowered into the center of coil 30. The amount of core 36 within coil 30 is represented by $\Delta Y$. As ferrite core 36 is lowered into the center of coil 30, $\Delta Y$ decreases and the inductance measured across leads 31, 32 will increase. Conversely, the inductance can be reduced by raising ferrite core 36 and increasing $\Delta Y$.

Figure 4:
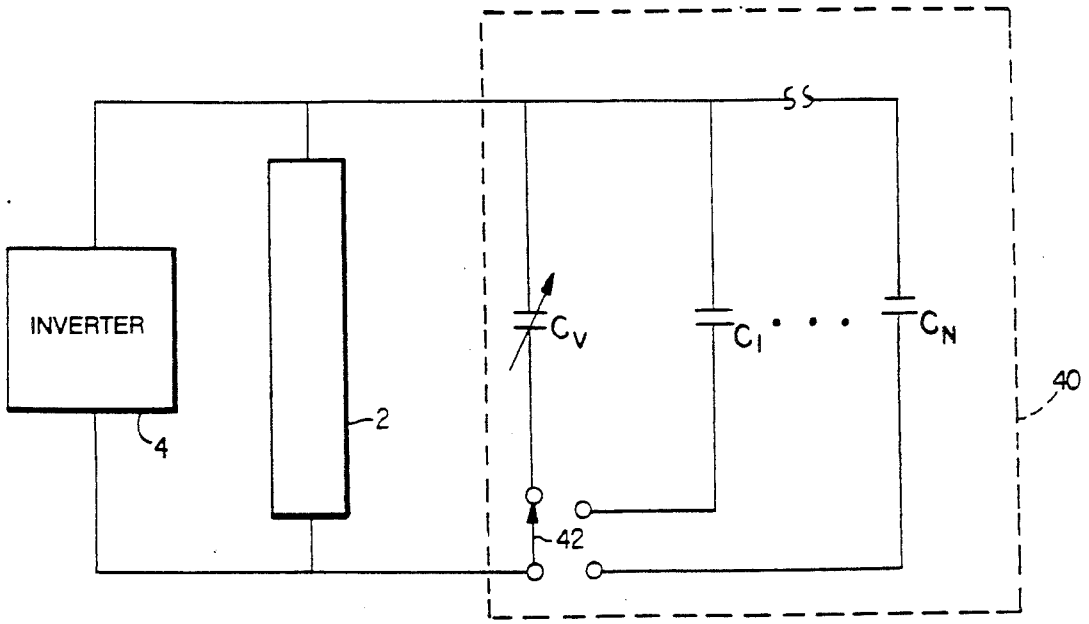
FIG. 4 is an alternative embodiment of the lighting fixture shown in FIG. 1.

FIG. 4 shows an alternate embodiment of the lighting fixture shown in FIG. 1. A control circuit 40 includes a variable capacitor $C_V$ and a plurality of fixed capacitors $C_1$–$C_N$. A switch 42 selectively connects one of the capacitors to lamp 2 in parallel. The capacitors used in this embodiment are standard, widely available capacitors. This embodiment is identical to the embodiment shown in FIG. 1, except variable inductor $L_V$ has been replaced with variable capacitor $C_V$, and fixed inductors $L_1$–$L_N$ have been replaced by fixed capacitors $C_1$–$C_N$. The embodiments of FIGS. 1 and 4 operate in a similar manner, and a detailed discussion of the operation of the embodiment of FIG. 4 is therefore not necessary. The use of capacitors will achieve the same beneficial effects as inductors.

The dimming control circuits described above accomplish light level control without adversely affecting the stability of the light output. The control circuits use a minimal amount of power, and allow the lamp to be quickly brought to full power from a low intensity setting.

The invention is not limited by the illustrative embodiments described above, and many changes and modifications may be made without departing from the spirit of the invention. For example, any appropriate inductor may be substituted for the inductors described above. The manually adjustable inductor described above can be servo driven. Similarly, a manually variable capacitor can be used or one varied by an appropriate servo. A control circuit could also be used that employs a combination of inductors and capacitors. While only one lamp is shown in the illustrative embodiment, the invention can clearly be used to control a plurality of lamps. Furthermore, the invention is not limited to dimming the output of a lamp. It may be used in other applications where it is desirable to control the power supplied to a load.

What is claimed is:

1. A lighting fixture comprising:

a fluorescent lamp;

a power source connected to said lamp through an inverter to provide suitable alternating current to said fluorescent lamp to enable said lamp to emit light; and a control circuit comprising a variable inductor connected in parallel with said lamp for varying the intensity of the light emitted by said lamp while keeping the light emitted by said fluorescent lamp substantially stable as the intensity of the light emitted by said fluorescent lamp is varied, said variable inductor being selectably adjustable to vary the intensity of the light emitted by said lamp.

2. The lighting fixture of claim 1 wherein said control circuit further comprises one or more fixed inductors, each having a fixed inductance, and a switch to connect either said variable inductor or a selected one of said fixed inductors in parallel with said lamp.

3. The lighting fixture of claim 2 wherein said control circuit comprises a plurality of fixed inductors having different inductances.

4. The lighting fixture of claim 1 wherein said variable inductor can be varied in step increments.

5. The lighting fixture of claim 1 wherein said variable inductor can be varied in continuous increments.

6. A lighting fixture comprising:

a discharge lamp;

a power source connected to said lamp through an inverter to provide suitable alternating current to said discharge lamp to enable said lamp to emit light; and a control circuit comprising a variable inductor connected in parallel with said lamp for varying the intensity of the light emitted by said lamp while keeping the light emitted by said discharge lamp substantially stable as the intensity of the light emitted by said discharge lamp is varied, said variable inductor being selectably adjustable to vary the intensity of the light emitted by said lamp.

7. The lighting fixture of claim 6 wherein said control circuit further comprises one or more fixed inductors, each having a fixed inductance, and a switch to connect either said variable inductor or a selected one of said fixed inductors in parallel with said lamp.

8. The lighting fixture of claim 7 wherein said control circuit comprises a plurality of fixed inductors having different inductances.

9. The lighting fixture of claim 6 wherein said variable inductor can be varied in step increments.

10. The lighting fixture of claim 6 wherein said variable inductor can be varied in continuous increments.

11. A lighting fixture comprising:

a fluorescent lamp;

a power source connected to said lamp through an inverter to provide suitable alternating current o said fluorescent lamp to enable said lamp to emit light; and a control circuit comprising an inductor connected to said lamp in parallel to regulate the intensity of light emitted by said lamp while keeping the light emitted by said fluorescent lamp substantially stable as the intensity of the light emitted by said fluorescent lamp is varied, said inductor being selectably adjustable to vary the intensity of the light emitted by said lamp.

12. The lighting fixture of claim 11 wherein said inductor is a variable inductor, and wherein the light emitted by said lamp can be regulated by varying the inductance of said variable inductor.

13. The lighting fixture of claim 11 wherein said control circuit further comprises a second inductor and a switch to connect either said first inductor or said second inductor to said lamp in parallel.

14. The lighting fixture of claim 13 wherein said first inductor is an inductor whose inductance can be varied and said second inductor is an inductor having a fixed inductance.

15. The lighting fixture of claim 13 wherein said first inductor has a fixed inductance, and said second inductor has a fixed inductance that is not equal to the fixed inductance of said first inductor.

16. The lighting fixture of claim 13 wherein said variable inductor can be varied in step increments.

17. The lighting fixture of claim 13 wherein said variable inductor can be varied in continuous increments.

18. The lighting fixture comprising:

a discharge lamp;

a power source connected to said lamp through an inverter to provide suitable alternating current to said discharge lamp to enable said lamp to emit light; and a control circuit comprising an inductor connected to said lamp in parallel to regulate the intensity of light emitted by said lamp while keeping the light emitted by said discharge lamp substantially stable as the intensity of the light emitted by said discharge lamp is varied, said inductor being selectably adjustable to vary the intensity of the light emitted by said lamp.

19. The lighting fixture of claim 18 wherein said inductor is a variable inductor, and wherein the light emitted by said lamp can be regulated by varying the inductance of said variable inductor.

20. The lighting fixture of claim 18 wherein said control circuit further comprises a second inductor and a switch to connect either said first inductor or said second inductor to said lamp in parallel.

21. The lighting fixture of claim 20 wherein said first inductor is an inductor whose inductance can be varied and said second inductor is an inductor having a fixed inductance.

22. The lighting fixture of claim 20 wherein said first inductor has a fixed inductance, and said second inductor has a fixed inductance that is not equal to the fixed inductance of said first inductor.

23. The lighting fixture of claim 20 wherein said variable inductor can be varied in step increments.

24. The lighting fixture of claim 20 wherein said variable inductor can be varied in continuous increments.

25. A lighting fixture comprising:

a fluorescent lamp;

a power source connected to said lamp through an inverter to provide suitable alternating current to said fluorescent lamp to enable said lamp to emit light; and a control circuit comprising a variable inductor, one or more fixed inductors, and a switch to connect one of said inductors to said lamp in parallel;

wherein the intensity of the light emitted by said lamp can be selectably regulated by selecting, through said switch, one of said inductors, the light emitted by said fluorescent lamp remaining substantially stable as the intensity of the light emitted by said fluorescent lamp is regulated.

26. A method for varying the intensity of light emitted by a discharge lamp comprising the steps of:

connecting a power source to said discharge lamp through an inverter to provide a suitable alternating current to said discharge lamp to enable said discharge lamp to emit light;

connecting a control circuit to said lamp, said control circuit comprising a variable inductor connected in parallel with said lamp; and selectably adjusting the inductance of said variable inductor, to vary the intensity of the light emitted by said discharge lamp while keeping the light emitted by said discharge lamp substantially stable as the intensity of the light emitted by said discharge lamp is varied.

27. The method of claim 26 wherein said lamp is a fluorescent lamp.

28. A method for varying the intensity of light emitted by a discharge lamp comprising the steps of connecting a power source to said discharge lamp through an inverter to provide a suitable alternating current to said discharge lamp to enable said discharge lamp to emit light;

connecting a control circuit to said lamp, said control circuit comprising a plurality of inductors having different inductances, one of said inductors being connected in parallel with said lamp; and selectably disconnecting said one of said inductors from said lamp and connecting another of said inductors in parallel with said lamp, to vary the intensity of the light emitted by said discharge lamp while keeping the light emitted by said discharge lamp substantially stable as the intensity of the light emitted by said discharge lamp is varied.

29. The method of claim 28 wherein said lamp is a fluorescent lamp.

30. A method for varying the intensity of light emitted by a discharge lamp by connecting a power source to said discharge lamp through an inverter to provide a suitable alternating current to said discharge lamp to enable said discharge lamp to emit light; and by selectively connecting and disconnecting one or more inductors in parallel with said lamp, to vary selectably the intensity of the light emitted by said discharge lamp while keeping the light emitted by said discharge lamp substantially stable as the intensity of the light emitted by said discharge lamp is varied.

31. The method of claim 30 wherein said lamp is a fluorescent lamp.

32. A lighting fixture comprising:

a fluorescent lamp;

a power source connected to said lamp through an inverter to provide a suitable alternative current to said fluorescent lamp to enable said lamp to emit light; and a control circuit comprising a variable capacitor connected in parallel with said lamp for varying the intensity of the light emitted by said lamp while keeping the light emitted by said fluorescent lamp substantially stable as the intensity of the light emitted by said fluorescent lamp is varied, said variable capacitor being selectably adjustable to vary the intensity of the light emitted by said lamp.

33. The lighting fixture of claim 32 wherein said control circuit further comprises one or more fixed capacitors, each having a fixed capacitance, and a switch to connect either said variable capacitor or a selected one of said fixed capacitors in parallel with said lamp.

34. The lighting fixture of claim 33 wherein said control circuit comprises a plurality of fixed capacitors having different capacitances.

35. The lighting fixture of claim 32 wherein said variable capacitor can be varied in step increments.

36. The lighting fixture of claim 32 wherein said variable capacitor can be varied in continuous increments.

37. A lighting fixture comprising:

a discharge lamp;

a power source connected to said lamp through an inverter to provide a suitable alternating current to said discharge lamp to enable said lamp to emit light; and a control circuit comprising a variable capacitor connected in parallel with said lamp for varying the intensity of the light emitted by said lamp while keeping the light emitted by said discharge lamp substantially stable as the intensity of the light emitted by said discharge lamp is varied, said variable capacitor being selectably adjustable to vary the intensity of the light emitted by said lamp.

38. The lighting fixture of claim 37 wherein said control circuit further comprises one or more fixed capacitors, each having a fixed capacitance, and a switch to connect either said variable capacitor or a selected one of said fixed capacitors in parallel with said lamp.

39. The lighting fixture of claim 38 wherein said control circuit comprises a plurality of fixed capacitors having different capacitances.

40. The lighting fixture of claim 37 wherein said variable capacitor can be varied in step increments.

41. The lighting fixture of claim 37 wherein said variable capacitor can be varied in continuous increments.

42. A lighting fixture comprising:

a fluorescent lamp;

a power source connected to said lamp through an inverter to provide a suitable alternating current to said fluorescent lamp to enable said lamp to emit light; and a control circuit comprising a capacitor connected to said lamp in parallel to regulate the intensity of light emitted by said lamp while keeping the light emitted by said fluorescent lamp substantially stable as the intensity of the light emitted by said fluorescent lamp is varied, said capacitor being selectably adjustable to vary the intensity of the light emitted by said lamp.

43. The lighting fixture of claim 42 wherein said capacitor is a variable capacitor, and wherein the light emitted by said lamp can be regulated by varying the capacitance of said variable capacitor.

44. The lighting fixture of claim 42 wherein said control circuit further comprises a second capacitor and a switch to connect either said first capacitor or said second capacitor to said lamp in parallel.

45. The lighting fixture of claim 44 wherein said first capacitor is an capacitor whose capacitance can be varied and said second capacitor is a capacitor having a fixed capacitance.

46. The lighting fixture of claim 44 wherein said first capacitor has a fixed capacitance, and said second capacitor has a fixed capacitance that is not equal to the fixed capacitance of said first capacitor.

47. The lighting fixture of claim 44 wherein said variable capacitor can be varied in step increments.

48. The lighting fixture of claim 44 wherein said variable capacitor can be varied in continuous increments.

49. A lighting fixture comprising:

a discharge lamp;

a power source connected to said lamp through an inverter to provide a suitable alternating current to said discharge lamp to enable said lamp to emit light; and a control circuit comprising a capacitor connected to said lamp in parallel to regulate the intensity of light emitted by said lamp while keeping the light emitted by said discharge lamp substantially stable as the intensity of the light emitted by said discharge lamp is varied, said capacitor being selectably adjustable to vary the intensity of the light emitted by said lamp.

50. The lighting fixture of claim 49 wherein said capacitor is a variable capacitor, and wherein the light emitted by said lamp can be regulated by varying the capacitance of said variable capacitor.

51. The lighting fixture of claim 49 wherein said control, circuit further comprises a second capacitor and a switch to connect either said first capacitor or said second capacitor to said lamp in parallel.

52. The lighting fixture of claim 51 wherein said first capacitor is an capacitor whose capacitance can be varied and said second capacitor is an capacitor having a fixed capacitance.

53. The lighting fixture of claim 51 wherein said first capacitor has a fixed capacitance, and said second capacitor has a fixed capacitance that is not equal to the fixed capacitance of said first capacitor.

54. The lighting fixture of claim 51 wherein said variable capacitor can be varied in step increments.

55. The lighting fixture of claim 51 wherein said variable capacitor can be varied in continuous increments.

56. A lighting fixture comprising:

a fluorescent lamp;

a fluorescent lamp;

a power source connected to said lamp through an inverter to provide a suitable alternating current to said fluorescent lamp to enable said lamp to emit light; and a control circuit comprising a variable capacitor, one or more fixed capacitors, and a switch to connect one of said capacitors to said lamp in parallel;

wherein the intensity of the light emitted by said lamp can be selectably regulated by selecting, through said switch, one of said capacitors, the light emitted by said fluorescent lamp remaining substantially stable as the intensity of the light emitted by said fluorescent lamp is regulated.

57. A method for varying the intensity of light emitted by a discharge lamp comprising the steps of:

connecting a power source to said discharge lamp through an inverter to provide a suitable alternating current to said discharge lamp to enable said discharge lamp to emit light;

connecting a control circuit to said lamp, said control circuit comprising a variable capacitor connected in parallel with said discharge lamp; and selectably adjusting the capacitance of said variable capacitor, to vary the intensity of the light emitted by said discharge lamp while keeping the light emitted by said discharge lamp substantially stable as the intensity of the light emitted by said discharge lamp is varied.

58. The method of claim 57 wherein said lamp is a fluorescent lamp.

59. A method for varying the intensity of light emitted by a discharge lamp comprising the steps of connecting a power source to said discharge lamp through an inverter to provide a suitable alternating current to said discharge lamp to enable said discharge lamp to emit light;

connecting a control circuit to said lamp, said control circuit comprising a plurality of capacitors having different capacitances, one of said capacitors being connected in parallel with said lamp; and selectably disconnecting said one of said capacitors from said lamp and connecting another of said capacitors in parallel with said lamp, to vary the intensity of the light emitted by said discharge lamp while keeping the light emitted by said discharge lamp substantially stable as the intensity of the light emitted by said discharge lamp is varied.

60. The method of claim 59 wherein said lamp is a fluorescent lamp.

61. A method for varying the intensity of light emitted by a discharge lamp by connecting a power source to said discharge lamp through an inverter to provide a suitable alternating current to said discharge lamp to enable said discharge lamp to emit light; and by selectively connecting and disconnecting one or more capacitors in parallel with said lamp, to vary selectably the intensity of the light emitted by said discharge lamp while keeping the light emitted by said discharge lamp substantially stable as the intensity of the light emitted by said discharge lamp is varied.

62. The method of claim 61 wherein said lamp is a fluorescent lamp.

* * * * *

UNITED STATES PATENT AND TRADEMARK OFFICE

CERTIFICATE OF CORRECTION

PATENT NO. : 5,140,228

DATED : August 18, 1992

INVENTOR(S) : George E. Biegel

It is certified that error appears in the above-identified patent and that said Letters Patent is hereby corrected as shown below:

TITLE PAGE

References Cited (U.S. PATENT DOCUMENTS)
Add the following references:
--4,864,482 7/1988 Quazi et al.--
--4,933,605 1/1988 Quazi et al.--
--4,943,886 2/1989 Quazi--

References Cited (FOREIGN PATENT DOCUMENTS)
Add the following reference:
--WO90/09727 8/1990 PCT--

Column 7, lines 67-68, claim 51, delete "," (comma) after --control--.
Column 8, line 17, claim 56, delete "a fluorescent lamp;" (duplicate of line 16).

Signed and Sealed this

Fourteenth Day of December, 1993

Bruce Lehman

*Attest:*

BRUCE LEHMAN

*Attesting Officer*

*Commissioner of Patents and Trademarks*